United States Patent [19]

Ferenzi

[11] Patent Number: 4,776,650

[45] Date of Patent: Oct. 11, 1988

[54] WALL MOUNTED COSMETIC CENTER

[76] Inventor: Benedict W. Ferenzi, 4137 W. 77th Pl., Chicago, Ill. 60652

[21] Appl. No.: 23,544

[22] Filed: Mar. 9, 1987

[51] Int. Cl.[4] ..... A40B 67/02

[52] U.S. Cl. ..... 312/245; 312/224; 211/13

[58] Field of Search ..... 206/566, 477, 443; 108/23; 312/245, 206, 207, 224, 324; 211/13, 87, 105.1

[56] References Cited

U.S. PATENT DOCUMENTS

| | | | |
|---|---|---|---|
| 1,254,132 | 1/1918 | Garman | 312/245 X |
| 2,089,999 | 8/1937 | Greene | 312/245 |
| 2,757,792 | 8/1956 | Shioleno | 312/13 X |
| 3,997,219 | 12/1976 | Phelps | 312/245 X |
| 4,058,356 | 11/1977 | Michal | 206/566 X |
| 4,094,256 | 6/1978 | Holper et al. | 312/223 X |
| 4,141,453 | 2/1979 | Hanan | 211/13 X |
| 4,209,212 | 6/1980 | McGoldrick | 312/245 |
| 4,329,002 | 5/1982 | Cowen et al. | 312/223 X |

FOREIGN PATENT DOCUMENTS

| | | | |
|---|---|---|---|
| 394433 | 6/1933 | United Kingdom | 312/45 |

*Primary Examiner*—Joseph Falk

*Attorney, Agent, or Firm*—Wood, Dalton, Phillips, Mason & Rowe

[57] ABSTRACT

A wall mounted cosmetic center including a generally box-like enclosure. The box-like enclosure is defined by a top wall, a bottom wall and a pair of side walls. It has a plurality of cosmetic-supporting shelves extending between the side walls in vertically spaced relation to the bottom wall and also has a plurality of drawers mounted under the shelves adjacent one of the side walls for reciprocating movement and a slotted compartment mounted into the shelves adjacent the other of the side walls in spaced relation to the drawers. The box-like enclosure further includes a makeup mirror-receiving opening between the bottom wall, drawers, compartment and the lowermost of the shelves. Additionally, a pair of drawers having inner surfaces for storing jewelry in an organized manner are hingedly mounted to the side walls of the box-like enclosure.

19 Claims, 1 Drawing Sheet

WALL MOUNTED COSMETIC CENTER

FIELD OF THE INVENTION

The present invention relates generally to cabinets that are mounted on walls and, more particularly, to an entirely self-contained wall mounted cosmetic center.

BACKGROUND OF THE INVENTION

As will be appreciated in particular by women, there are many different types of cosmetics that are used at different times. These include lipstick, nail polish, mascara, eye liner pencils, lip gloss and the like. Also, other items including lotions, cologne and perfume are commonly used in cleaning and grooming oneself.

Further, it is common for women to own a variety of different types of jewelry. This usually includes necklaces, bracelets, rings, watches, and earrings, as well as such other grooming items as hairpins and barrettes. As with cosmetics and toiletries, jewelry is often maintained in a disorganized manner due to the large quantity that is usually accumulated over a period of time.

Still further, most women own a variety of implements and appliances for grooming purposes. These typically include curling irons, hot curlers, scissors, eyelash curlers, tweezers, lighted makeup mirrors and the like. Once again, these items are oftentimes not maintained in an organized manner.

As a result, the average woman is usually faced with considerable difficulty in quickly locating a needed cosmetic, toiletry, piece of jewelry, implement or appliance. Even when located, it is usually the case that these items are maintained in a disorganized manner that renders the bathroom, dressing room or bedroom area in which they are maintained unsightly at best. As a result, it has remained to provide a means for coordinating the storage and utilization of such items.

The present invention is directed to overcoming the above-stated problems and accomplishing the stated objects by providing a wall mounted cosmetic center.

SUMMARY OF THE INVENTION

Accordingly, the present invention is directed to a wall mounted cosmetic center including a generally box-like enclosure defined by a top wall, a bottom wall and a pair of side walls. The enclosure has a plurality of cosmetic-supporting shelves extending between the side walls in vertically spaced relation to the bottom wall and also has a plurality of drawers mounted under the shelves adjacent one of the side walls for reciprocating movement. The box-like enclosure further has a slotted compartment mounted under the shelves adjacent the other of the side walls in spaced relation to the drawers and includes a makeup mirror-receiving opening between the bottom wall, drawers, compartment and the lowermost of the shelves. With this construction, a pair of doors having inner surfaces with means for storing jewelry in an organized manner are hingedly mounted to the side walls of the box-like enclosure for movement from a position entirely closing the enclosure to a position entirely opening the enclosure.

In an exemplary embodiment, the box-like enclosure is rectangular in shape. The side walls are disposed in parallel relation and the top and bottom walls are disposed in parallel relation, as well. Also, the doors are preferably rectangular in shape.

Further, the box-like enclosure includes a plurality of drawer supporting surfaces disposed in vertically spaced relation. The drawers then each have an open top and one of the drawer supporting surfaces is a portion of the bottom wall adjacent to one of the side walls with another of the drawer supporting surfaces being a drawer supporting shelf intermediate the bottom wall and the lowermost of the cosmetic supporting shelves. Additionally, the drawer supporting shelf preferably extends between the one of the side walls and the vertically extending inner wall.

With this feature, the vertically extending inner wall extends from the bottom wall to the lowermost of the cosmetic supporting shelves. Moreover, the vertically extending inner wall defines a portion of the mirror-receiving opening adjacent the drawers.

In the exemplary embodiment, the slotted compartment is rectangular in shape. It also includes a plurality of vertically extending divider walls extending from a bottom compartment wall upwardly to a point adjacent the lowermost of the cosmetic supporting shelves. In addition, the innermost of the vertically extending divider walls defines a portion of the mirror-receiving opening adjacent the compartment.

Still further, the bottom compartment wall is in vertically spaced relation to the bottom wall of the boxlike enclosure. The bottom compartment wall, the bottom wall of the enclosure and the other of the side walls preferably defines a discrete storage compartment. Advantageously, the discrete storage compartment includes means for hanging a plurality of implements therewithin.

Preferably, the vertically extending divider walls are spaced apart varying distances. Thus, the vertically extending divider walls define a plurality of slots of varying width. Moreover, the bottom compartment wall preferably slopes rearwardly toward the bottom wall of the box-like enclosure.

In the preferred embodiment, one of the doors includes a plurality of rows of hooks associated with the inner surface thereof. Each of the hooks is then adapted to support a piece of jewelry in a hanging manner with the hooks comprising the means for storing jewelry in an organized manner. With this construction, each of the rows of hooks is preferably defined by a flat horizontally extending strip carrying a plurality of jewelry-supporting hooks thereon.

Advantageously, each of the strips is mounted on the inner surfaces of the one of the doors in closely spaced adjacent to support a plurality of pieces of jewelry in a hanging manner. A mounting slot is preferably provided at each end of each of the strips and a pair of outwardly projecting tabs is provided for each of the strips and secured to the inner surface of the one of the doors. With this construction, each of the tabs has a mating mounting slot for receiving one of the mounting slots of the strips.

Preferably, the mounting slots of the strip face downwardly and the mating mounting slots of the tab face upwardly. In this case, the weight of the plurality of pieces of jewelry act to maintain the mounting slots of the strips in engagement with the mating mounting slots of the tabs. Preferably, the hooks are carried inwardly of the mounting slots which are provided at the ends of the strips.

In the preferred embodiment, one of the doors also includes a plurality of rows of slots associated with the inner surface thereof. Each of the slots is preferably adapted to support a piece of jewelry in a slot-confining manner with the slots comprising the means for storing jewelry in an organized manner. Advantageously, each of the rows of slots is defined by a flat horizontally extending strip having a plurality of jewelry supporting slots therein.

Additional details include one of the doors having at least one flat horizontally extending magnetic strip for supporting metallic objects thereon. This strip is then mounted on the inner surface of the one of the doors in closely spaced adjacent relation. Preferably, the strip is adapted to support a plurality of metallic objects such as hairpins and barrettes in magnetic attraction manner.

In the preferred embodiment, a wall mounted makeup table is provided. The makeup table is adapted to be mounted below the box-like enclosure in centered relation to the mirror-receiving opening and projects outwardly by a distance greater than the enclosure. With this construction, the makeup table can include an electrical outlet strip integrally associated therewith.

Preferably, the electrical outlet strip has an on-off switch and a plurality of receptacles associated therewith. The electrical outlet strip also advantageously has a cord with a plug adapted to be inserted into a household electrical receptacle and the makeup table further includes a plurality of hooks proximate the electrical outlet strip, each of which is adapted to support an electrical appliance adapted to be electrically connected to the electrical outlet strip. With this construction, the electrical outlet strip and the hooks are disposed in remote relation to the mirror-receiving opening.

Still other objects, advantages and features of the present invention will become apparent from the following specification taken in conjunction with the accompanying drawings.

DETAILED DESCRIPTION OF THE PREFERRED EMBODIMENT

Figure 1:
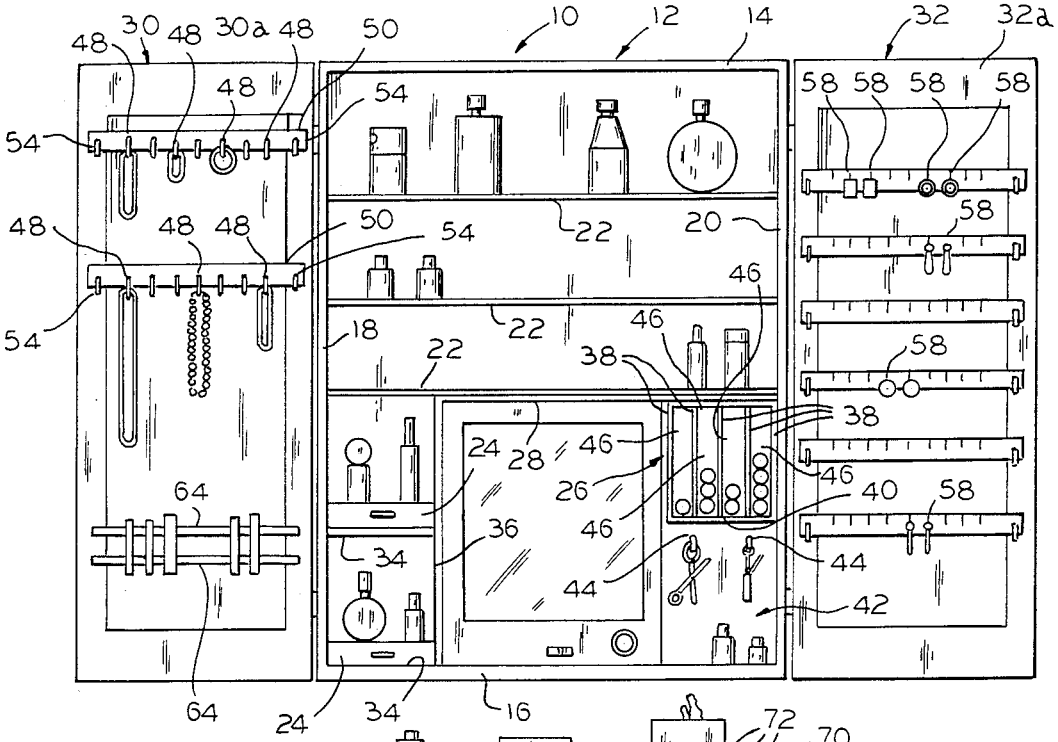
FIG. 1 is a front elevational view, with doors opened, of the wall cosmetic center of the present invention.

An exemplary embodiment of a wall mounted cosmetic center in accordance with the invention is illustrated in FIG. 1. The cosmetic center 10 comprises a generally box-like enclosure 12 defined by a top wall 14, a bottom wall 16 and a pair of side walls 18 and 20. The enclosure 12 has a plurality of cosmetic supporting shelves 22 extending between the side walls 18,20 in vertically spaced relation to the bottom wall 16 and also has a plurality of drawers 24 mounted under the shelves 22 adjacent one of the side walls 18 for reciprocating movement. The enclosure 12 further has a slotted compartment 26 mounted under the shelves 22 adjacent the other of the side walls 20 in spaced relation to the drawers 24 and includes a makeup mirror-receiving opening 28 between the bottom wall 16, drawers 24, compartment 26 and the lowermost of the shelves 22. In addition, the cosmetic center 10 includes a pair of doors 30,32 having inner surfaces **30*a* and 32*a* with means for storing jewelry in an organized manner, and the doors 30 and 32 are hingedly mounted to the side walls 18,20 for movement from a position entirely closing the enclosure 12 (see FIG. 2) to a position entirely opening the enclosure 12 (see FIG. 1**).

Still referring to FIG. 1, the box-like enclosure 12 is rectangular in shape. It will also be seen that the side walls 18 and 20 are disposed in parallel relation and the top and bottom walls 14 and 16 are also disposed in parallel relation. With this construction, the doors 30,32 are rectangular in shape as well.

The box-like enclosure 12 includes a plurality of drawer-supporting surfaces 34 disposed in vertically spaced relation. It will also be appreciated by referring to FIG. 1 that the drawers 24 each preferably have an open top which renders it possible for the drawers to support relatively tall bottles and jars of cosmetics and the like, i.e., bottles and jars which are taller than the face of the drawers 24. As will be appreciated, one of the drawer supporting surfaces 34 is a portion of the bottom wall 16 adjacent the one of the side walls 18.

Still referring to FIG. 1, another of the drawer supporting surfaces 34 is a drawer supporting shelf intermediate the bottom wall 16 and the lowermost of the cosmetic supporting shelves 22. The drawer supporting shelf 34 extends between the one of the side walls 18 and a vertically extending inner wall 36. With this construction, the vertically extending inner wall 36 preferably extends from the bottom wall 16 to the lowermost of the cosmetic supporting shelves 22 defining a portion of the mirror-receiving opening 28 adjacent the drawers 24.

As will also be appreciated by referring to FIG. 1, the slotted compartment 26 is rectangular in shape. It includes a plurality of vertically extending divider walls 38 extending from a bottom compartment wall 40 upwardly to a point adjacent the lowermost of the cosmetic supporting shelves 22. Further, the innermost of the vertically extending divider walls 38 defines a portion of the mirror-receiving opening 28 adjacent the compartment 26.

As shown, the bottom compartment wall 40 is in vertically spaced relation to the bottom wall 16 of the box-like enclosure 12. The bottom compartment wall 40, bottom wall 16 of the enclosure 12 and the other of the side walls 20 define a discrete storage compartment generally designated 42. In addition, the discrete storage compartment 42 includes means such as hooks 44 for hanging a plurality of grooming implements therewithin.

Preferably, the vertically extending divider walls 38 are spaced apart varying distances. Thus, the vertically extending divider walls 38 define a plurality of slots 46 of varying width. Also, as shown, the bottom compartment wall 40 preferably slopes rearwardly toward the bottom wall 16 of the box-like enclosure 12.

Still referring to FIG. 1, one of the doors 30 includes a plurality of rows of hooks 48 associated with the inner surface **30*a* thereof. Each of the hooks 48 is adapted to support a piece of jewelry in a hanging manner. As will be appreciated by those skilled in the art, the hooks 48** comprise the means for storing jewelry in an organized manner.

Figure 4:
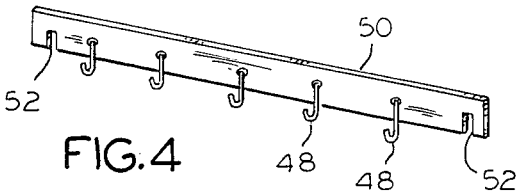
FIG. 4 is a perspective view of a strip having jewelry supporting hooks thereon.

As shown, each of the rows of hooks 48 is defined by a flat, horizontally extending strip 50. The flat, horizontally extending strips 50 each have a plurality of jewelry supporting hooks 48 thereon (see, also, FIG. 4), and each of the strips 50 is mounted on the inner surface **30*a* of the one of the doors 30 in closely spaced adjacent relation to support a plurality of pieces of jewelry in a hanging manner. In addition, each of the strips 50 includes a mounting slot 52** at each end thereof.

Figure 5:
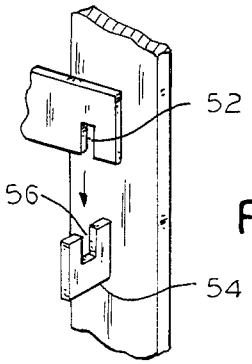
FIG. 5 is a perspective view illustrating the mounting means for the strips of FIGS. 3 and 4.

Referring to FIGS. 1 and 5, a pair of outwardly projecting tabs 54 for each of the strips 50 is secured to the inner surface 30*a* of the one of the doors 30. Each of the tabs 54 has a mating mounting slot 56 for receiving one of the mounting slots 52 of the strips 50 and, as shown, the mounting slots 52 of the strips 50 face downwardly with the mating mounting slots 56 of the tabs 54 facing upwardly. With this arrangement, the weight of the plurality of pieces of jewelry act to maintain the mounting slots 52 of the strips 50 in engagement with the mating mounting slots 56 of the tabs 54. Preferably, the hooks 48 are carried inwardly of the mounting slots 52 which are provided at the end of the strips 50.

Figure 3:
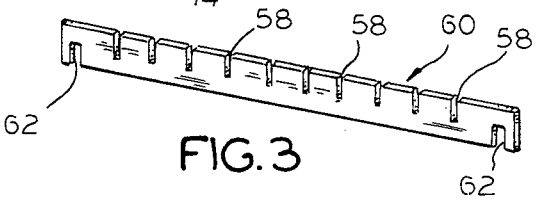
FIG. 3 is a perspective view of a strip having jewelry supporting slots therein.

Referring once again to FIG. 1, one of the doors 32 includes a plurality of rows of slots 58 associated with the inner surface 32*a* thereof. Each of the slots 58 is adapted to support a piece of jewelry in a slot-confining manner and also comprises the means for storing jewelry in an organized manner. Preferably, each of the rows of slots 58 is defined by a flat horizontally extending strip 60 having a plurality of jewelry supporting slots 58 therein (see also FIG. 3).

With this construction, each of the strips 60 is mounted on the inner surface 32*a* of the one of the doors 32 in closely spaced adjacent relation. It will be appreciated, of course, that each of the strips 60 is adapted to support a plurality of pieces of jewelry in a slot-confining manner, as shown in FIG. 1. Moreover, as with the strip 50 illustrated in FIG. 4, the strip 60 includes a mounting slot 62 at each end thereof.

While not specifically shown, it will be understood that the mounting slots 62, which face downwardly, are adapted to cooperate with the upwardly facing mating mounting slots 56 of the tabs 54. The weight of the plurality of pieces of jewelry again act to maintain the mounting slots 62 of the strips 60 in engagement with the mating mounting slots 56 of the tabs 54. Also, as before, the jewelry supporting slots 58 are preferably carried inwardly of the mounting slots 62 which are provided at the ends of the strips 60.

Referring once again to FIG. 1, one of the doors 30 includes at least one flat horizontally extending magnetic strip 64 for supporting metallic objects thereon. The strip or strips 64 (a pair being shown in FIG. 1) are mounted on the inner surface 30*a* of the one of the doors 30 in closely spaced adjacent relation. In this manner, the strip or strips 64 are adapted to support a plurality of metallic objects in magnetic attraction manner.

Figure 2:
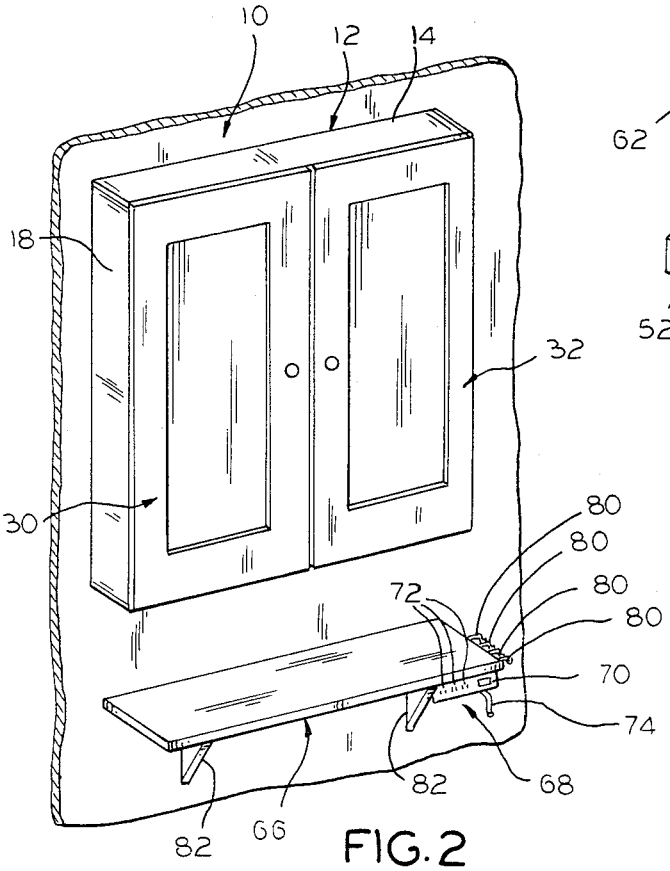
FIG. 2 is a perspective view, with doors closed, of the wall mounted cosmetic center of FIG. 1.

As best shown in FIGS. 1 and 2, the cosmetic center 10 preferably also includes a wall mounted makeup table 66. The makeup table 66 is adapted to be mounted below the box-like enclosure 12 in centered relation to the mirror-receiving opening 28 and projects outwardly by a distance greater than the projection of the enclosure 12. Moreover, the makeup table 66 preferably includes an electrical outlet strip 68 integrally associated therewith.

As shown in FIG. 1, the electrical outlet strip 68 has an on-off switch 70 and a plurality of receptacles 72 associated therewith. It will also be seen that the electrical outlet strip 68 has a cord 74 with a plug 76 adapted to be inserted into a household electrical receptacle generally designated 78, and the makeup table 66 preferably includes a plurality of hooks such as 80 each for supporting an electrical appliance adapted to be electrically connected to the electrical outlet strip 68. As shown, the electrical outlet strip 68 and the hooks 80 are preferably disposed in remote relation to the mirror-receiving opening 28.

Still referring to the drawings, the unique design of the cosmetic center 10 allows for the permanent mounting of a lighted makeup mirror therein. This is accomplished by forming the box-like enclosure 12 so as to have a mirror-receiving opening 28 sized to receive all conventional commercial brands of lighted makeup mirrors. As a result, the lighted makeup mirror can be permanently disposed in a desired position for immediate utilization upon opening the two doors of the cosmetic center.

As will also be appreciated, the cosmetic center is uniquely capable of conveniently storaging makeup, perfume, nail products, jewelry and the like. The flat strips bearing the hooks and/or slots allow for hanging necklaces, bracelets, rings, watches and/or earrings, the latter of which are particularly well suited for storage in the slots in the strips which can be formed of plastic. As for the tabs, it will be appreciated that they, too, can be formed of plastic for mounting on the inside surface of the doors.

With the wall mounted makeup table spaced below the box-like enclosure, additional space is provided for hot curlers, facial tissues and the like. This makeup table also allows for resting of an elbow to steady the hand while applying makeup, and the electrical outlet strip allows for plugging in curling irons, hot curlers, hair dryers and the like. Further, by providing hooks on the makeup table, the curling irons and hair dryers can be temporarily stored by hanging.

As shown in FIG. 1, the wall mounted makeup table 66 can be mounted by means of variably spaced brackets 82. These brackets 82 are adjustable in width to allow for mounting into wall studs for a secure mounting of the wall mounted makeup table 66. As will be appreciated, a secure mounting is required where the elbow is to be rested on the makeup table 66.

While not specifically mentioned in the above description, it will be appreciated that the cosmetic supporting shelves can be made adjustable within the box-like enclosure 12. It is also preferable for the shelves to be of a lesser depth than the depth of the top and bottom walls 14,16 and the side walls 18,20 in order to facilitate closing the doors 30,32 with jewelry supported in the strips 50,60 in the manner described. In this manner, the doors 30,32 can be closed as illustrated in FIG. 2 to completely conceal the contents of the box-like enclosure 12.

As will also be appreciated, the slots 46 are of varying widths to accommodate various items. These include the ability to stack eyeliner pencils on their side, the ability to stack lipstick and mascara on their side, and the ability to allow for stacking large lip gloss and other similar shaped objects on their side. Still further, by sloping the bottom compartment wall 40 by an angle of 15°, all such stacked objects will be suitably retained within the slotted compartment 26.

As for the drawers 24, they can be pulled out to gain easy access to small bottles such as nail polish. The spacing between the drawers 24 is such that such bottles can easily be accommodated and, with the open top of the drawers, the bottles can quickly be removed therefrom. It will further be appreciated that the hooks 44 are provided to hang scissors, eyelash curlers, tweezers and the like under the slotted compartment 26. The discrete compartment 42 containing the hooks 44 is easily accessible for removal of the grooming implements upon demand. Of course, with the cosmetic supporting shelves 22, much more storage space is provided for other cosmetics, toiletries, personal hygiene articles and the like in an entirely organized fashion.

While in the foregoing there has been set forth a preferred embodiment of the invention, it is to be understood that the invention is only to be limited by the spirit and scope of the appended claims.

I claim:

1. A wall mounted cosmetic center, comprising:

a generally box-like enclosure defined by a top wall, a bottom wall and a pair of side walls, said enclosure having a plurality of cosmetic-supporting shelves extending between said side walls in vertically spaced relation to said bottom wall, said enclosure also having a plurality of drawers mounted under said shelves adjacent one of said side walls for reciprocating movement, said enclosure having a drawer supporting surface for each of said drawers, said drawer supporting sufaces being disposed in vertically spaced relation, said drawers each having a face and an open top for supporting articles taller than said faces of said drawers said enclosure further having a slotted compartment mounted under said shelves adjacent the other of said side walls in spaced relation to said drawers;

said box-like enclosure including a makeup mirror-receiving opening between said bottom wall, drawers, compartment and the lowermost of said shelves; and a pair of doors hingedly mounted to said side walls of said box-like enclosure, said doors being mounted for movement from a position entirely closing said enclosure to a position entirely opening said enclosure, said doors having inner surfaces with means for storing jewelry in an organized manner thereon.

2. The wall mounted cosmetic center as defined by claim 1 wherein said box-like enclosure is rectangular in shape, said side walls being disposed in parallel relation and said top and bottom walls being disposed in parallel relation, said doors also being rectangular in shape.

3. The wall mounted cosmetic center as defined by claim 1 wherein one of said drawer supporting surfaces is a portion of said bottom wall adjacent the one of said side walls, another of said drawer supporting surfaces being a drawer supporting shelf intermediate said bottom wall and the lowermost of said cosmetic supporting shelves, said drawer supporting shelf extending between the one of said side walls and a vertically extending inner wall.

4. The wall mounted cosmetic center as defined by claim 3 wherein said vertically extending inner wall extends from said bottom wall to the lowermost of said cosmetic supporting shelves, said vertically extending inner wall defining a portion of said mirror-receiving opening adjacent said drawers.

5. The wall mounted cosmetic center as defined by claim 1 wherein said slotted compartment is rectangular in shape, said slotted compartment including a plurality of vertically extending divider walls extending from a bottom compartment wall upwardly to a point adjacent the lowermost of said cosmetic supporting shelves, the innermost of said vertically extending divider walls defining a portion of said mirror-receiving opening adjacent said compartment.

6. The wall mounted cosmetic center as defined by claim 5 wherein said bottom compartment wall is in vertically spaced relation to said bottom wall of said box-like enclosure, said bottom compartment wall, bottom wall of said enclosure and the other of said side walls defining a discrete storage compartment, said discrete storage compartment including means for hanging a plurality of implements therewithin.

7. The wall mounted cosmetic center as defined by claim 5 wherein said vertically extending divider walls are spaced apart varying distances, said vertically extending divider walls defining a plurality of slots of varying width, said bottom compartment walls sloping rearwardly toward said bottom wall of said box-like enclosure.

8. The wall mounted cosmetic center as defined by claim 1 wherein one of said doors includes a plurality of rows of hooks associated with said inner surface thereof, each of said hooks being adapted to support a piece of jewelry in a hanging manner, said hooks comprising said means for storing jewelry in an organized manner.

9. The wall mounted cosmetic center as defined by claim 8 wherein each of said rows of said hooks is defined by a flat horizontally extending strip carrying a plurality of jewelry supporting hooks thereon, each of said strips being mounted on said inner surface of the one of said doors in closely spaced adjacent relation, each of said strips being adapted to support a plurality of pieces of jewelry in a hanging manner.

10. The wall mounted cosmetic center as defined by claim 9 wherein each of said strips includes a mounting slot at each end thereof, and including a pair of outwardly projecting tabs for each of said strips secured to said inner surface of the one of said doors, each of said tabs having a mating mounting slot for receiving one of said mounting slots of said strips.

11. The wall mounted cosmetic center as defined by claim 10 wherein said mounting slots of said strips face downwardly and said mating mounting slots of said tabs face upwardly, the weight of said plurality of pieces of jewelry acting to maintain said mounting slots of said strips in engagement with said mating mounting slots of said tabs, said hooks being carried inwardly of said mounting slots.

12. The wall mounted cosmetic center as defined by claim 1 wherein one of said doors includes a plurality of rows of slots associated with said inner surface thereof, each of said slots being adapted to support a piece of jewelry in a slot-confining manner, said slots comprising said means for storing jewelry in an organized manner.

13. The wall mounted cosmetic center as defined by claim 12 wherein each of said rows of slots is defined by a flat horizontally extending strip having a plurality of jewelry supporting slots therein, each of said strips being mounted on said inner surface of the one of said doors in closely spaced adjacent relation, each of said strips being adapted to support a plurality of pieces of jewelry in a slot-confining manner.

14. The wall mounted cosmetic center as defined by claim 13 wherein each of said strips includes a mounting slot at each end thereof, and including a pair of outwardly projecting tabs for each of said strips secured to said inner surface of the one of said doors, each of said tabs having a mating mounting slot for receiving one of said mounting slots of said strips.

15. The wall mounted cosmetic center as defined by claim 14 wherein said mounting slots of said strips face downwardly and said mating mounting slots of said tabs face upwardly, the weight of said plurality of pieces of jewelry acting to maintain said mounting slots of said strips in engagement with said mating mounting slots of said tabs, said jewelry supporting slots being carried inwardly of said mounting slots.

16. The wall mounted cosmetic center as defined by claim 1 wherein one of said doors includes at least one flat horizontally extending magnetic strip for supporting metallic objects thereon, said strip being mounted on said inner surface of the one of said doors in closely spaced adjacent relation, said strip being adapted to support a plurality of metallic objects in magnetic attraction manner.

17. The wall mounted cosmetic center as defined by claim 1 including a wall mounted makeup table, said make-up table being adapted to be mounted below said box-like enclosure in centered relation to said mirror-receiving opening, said makeup table projecting outwardly by a distance greater than said enclosure.

18. The wall mounted cosmetic center as defined by claim 17 wherein said makeup table includes an electrical outlet strip integrally associated therewith, said electrical outlet strip having an on-off switch and a plurality of receptacles associated therewith, said electrical outlet strip having a cord with a plug adapted to be inserted into a household electrical receptacle.

19. The wall mounted cosmetic center as defined by claim 18 wherein said makeup table includes a plurality of hooks proximate said electrical outlet strip, each of said hooks being provided to support an electrical appliance adapted to be electrically connected to said electrical outlet strip, said electrical outlet strip and said hooks being disposed in remote relation to said mirror-receiving opening.

* * * * *